US006230638B1

(12) United States Patent
Ownbey et al.

(10) Patent No.: US 6,230,638 B1
(45) Date of Patent: May 15, 2001

(54) SYSTEM FOR DIRECTIONAL AIR ENHANCEMENT OF A TEXTILE TUFTING MACHINE

(75) Inventors: Charles J. Ownbey, Dalton, GA (US); Michael K. Whitener, Spanish Fort; Tommy P. Browning, Mobile, both of AL (US)

(73) Assignee: Masland Carpets, Inc., Saraland, AL (US)

( * ) Notice: Subject to any disclaimer, the term of this patent is extended or adjusted under 35 U.S.C. 154(b) by 0 days.

(21) Appl. No.: 09/482,952

(22) Filed: Jan. 14, 2000

Related U.S. Application Data

(60) Provisional application No. 60/115,904, filed on Jan. 14, 1999.

(51) Int. Cl.[7] ..... D05C 15/16

(52) U.S. Cl. ..... 112/80.7; 112/302

(58) Field of Search ..... 112/80.07, 80.7, 112/98, 100, 286, 287, 288, 302, DIG. 1, DIG. 2, DIG. 3

(56) References Cited

U.S. PATENT DOCUMENTS 3,263,631 * 8/1966 Freeman ..... 112/80.07
3,371,632 * 3/1968 Snyder et al. ..... 112/286 X
3,611,958 * 10/1971 Rutledge ..... 112/80.71
3,824,939 * 7/1974 Spanel et al. ..... 112/80.07
4,316,421 * 2/1982 Ketterer ..... 112/302 X
4,852,505 8/1989 Dedmon .
5,143,003 9/1992 Dedmon .

* cited by examiner

*Primary Examiner*—Ismael Izaguirre
(74) *Attorney, Agent, or Firm*—Parkhurst & Wendel L.L.P.

(57) ABSTRACT

A tufting machine for inserting yarns into stitching in a base fabric, the machine having at least one needle bar, a reciprocating carrier for the needle bar, a support for a base fabric in a plane substantially transverse to the reciprocation direction of said carrier, needles carried by the needle bar(s) for penetrating a base fabric, and a device for delivering a stream or sheet of air adjacent the base fabric plane toward the needles and substantially parallel to that plane, the air stream or sheet moving faster than and in substantially the direction of movement as a base fabric being tufted by the machine, for aligning substantially parallel to the direction of base fabric movement fiber or yarn tails extending from the needles.

6 Claims, 3 Drawing Sheets

SYSTEM FOR DIRECTIONAL AIR ENHANCEMENT OF A TEXTILE TUFTING MACHINE

This application claims benefit of 60/115,904 filed Jan. 14, 1999.

The present invention relates to a system for directional air enhancement of the performance of textile tufting machines. Both apparatus and method for such directional air enhancement are described herein.

BACKGROUND

Textile tufting machines insert yarns into a base fabric layer, which may be a woven, knit, or non-fibrous material in the form of a plane of base fabric material having a substantial degree of integrity. In tufting machines, yarns of tuft material are typically stitched into such a base fabric by a series of needles that penetrate the base fabric into which the tuft yarn is inserted.

The advantageous air enhancement system of the present invention is useful with tufting machines such as those described in Dedmon U.S. Pat. No. 4,852,505 and/or Dedmon U.S. Pat. No. 5,143,003, both of which are hereby entirely incorporated by reference herein, as well as the prior art tufting machines described in and/or cited against the Dedmon '505 and/or '003 patents, as well as other known tufting machines.

BRIEF SUMMARY OF THE INVENTION

An object of the present invention is to prevent entanglement of yarn or fiber tails extending from one or more adjacent needles to thereby provide a more uniform tufted textile product.

The foregoing object and others are achieved in the present invention where in a tufting machine for inserting yarns into stitching in a base fabric, which machine has one or more needle bars, a reciprocating carrier for the needle bar(s), a support for a base fabric in a plane substantially transverse to the reciprocation direction of the carrier, and needles carried by the needle bar(s) for penetrating the fabric, the machine also includes means for delivering a stream or sheet of air adjacent the base fabric plane toward the needles and substantially parallel to that plane, with the air stream or sheet moving faster than and in substantially the direction of movement as a base fabric being tufted by the machine, for aligning substantially parallel to the direction of base fabric movement fiber or yarn tails extending from the needles.

BRIEF DESCRIPTION OF THE DRAWINGS

The present invention is described herein in conjunction with the following drawings, wherein.

DETAILED DESCRIPTION OF THE INVENTION

Figure 1:
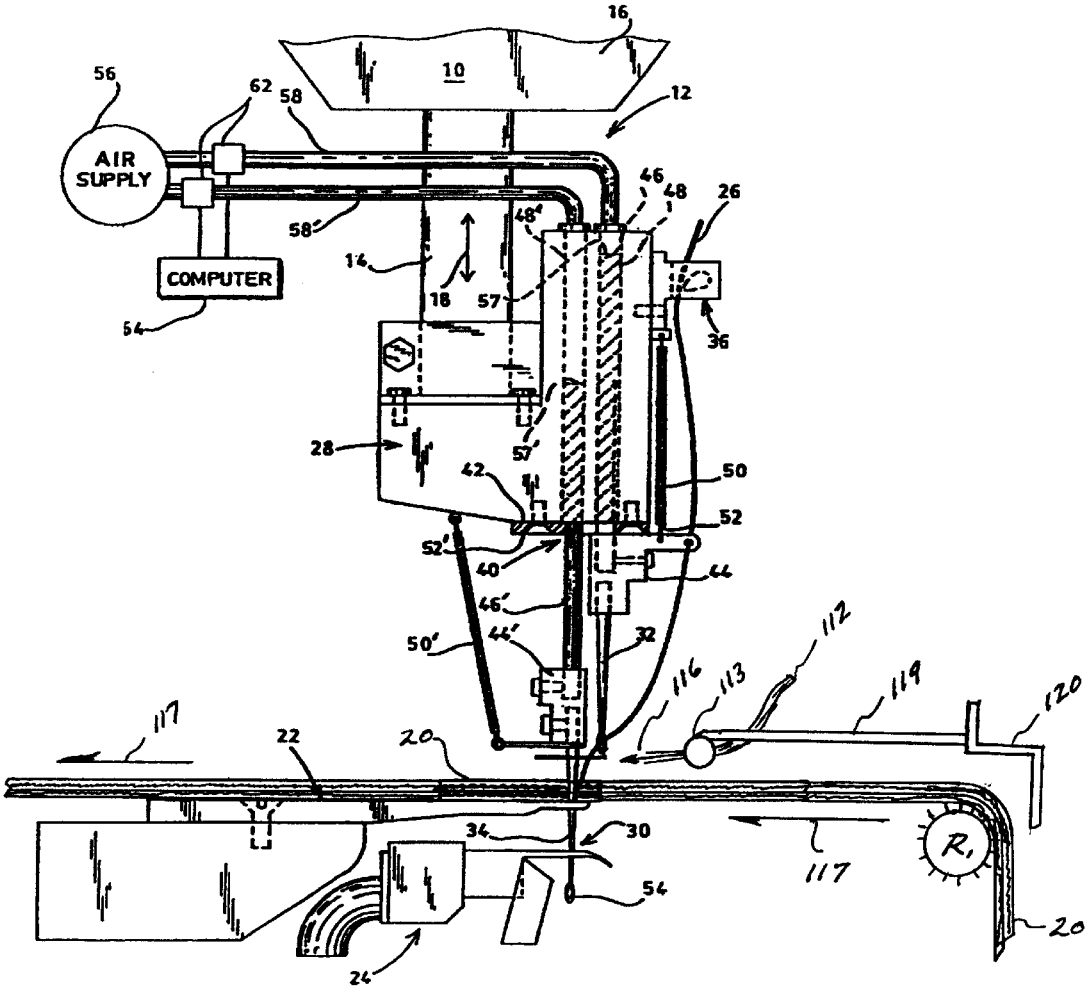
FIG. 1 is a partially schematic side view of the needle bar region of a tufting machine including the advantageous directional air enhancement system of the present invention.
Figure 2:
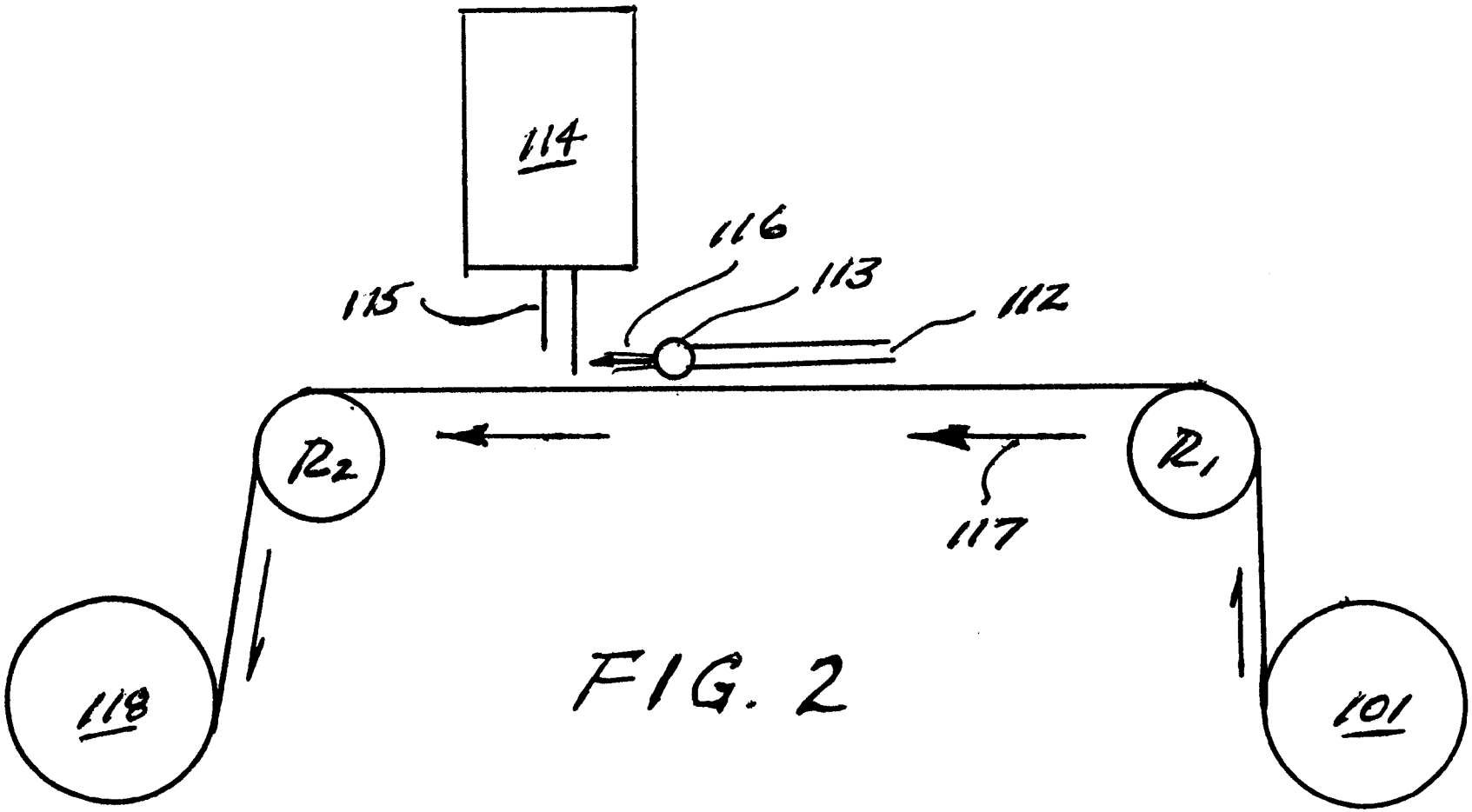
FIG. 2 is a more extensive schematic side view of a tufting machine including the advantageous air enhancement system of the present invention.

FIGS. 1 and 2 schematically illustrate, in side views, a textile tufting machine having the advantageous directional air enhancement system of the present invention. In FIG. 2, a primary backing fabric 101 is shown emerging from a supply roll 101, passing over an initial roll $R_1$ and then progressing substantially horizontally from right to left under a perforated tube 113 to which air is supplied through air supply 112. A primary backing fabric 101 passes under needle bar 114 carrying tufting needles 115. The primary backing fabric continues right to left horizontal movement indicated by arrow 117 passing over exit roll $R_2$ and then being collected on tufted fabric roll 118.

Figure 3:
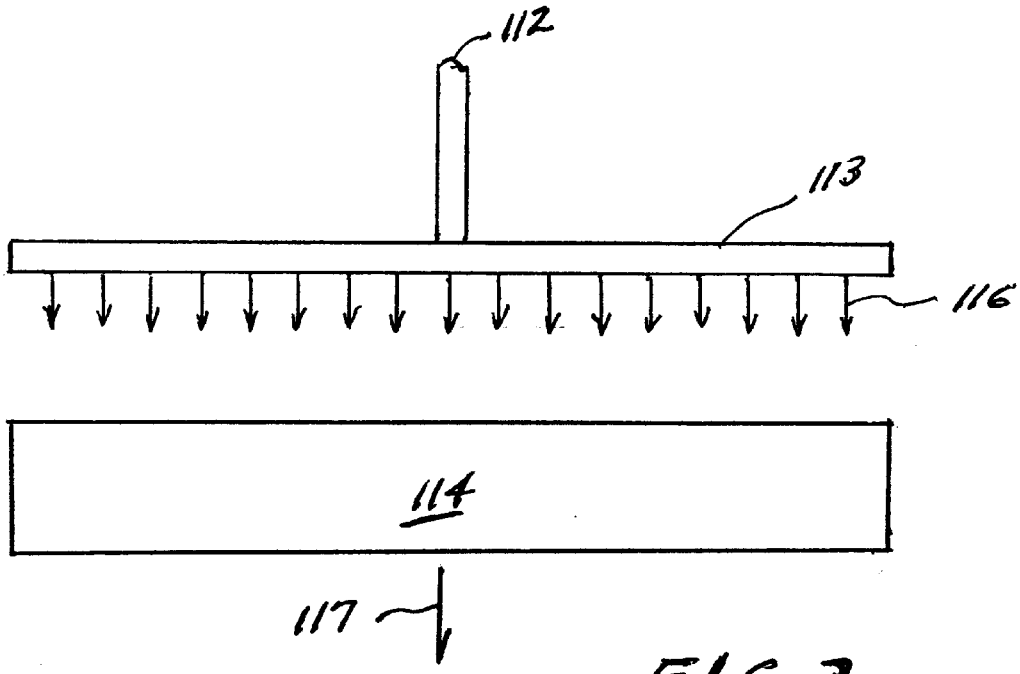
FIG. 3 is a partially schematic top view of a needle bar of a tufting machine with an adjacent advantageous directional air enhancement system of the present invention.
Figure 4:
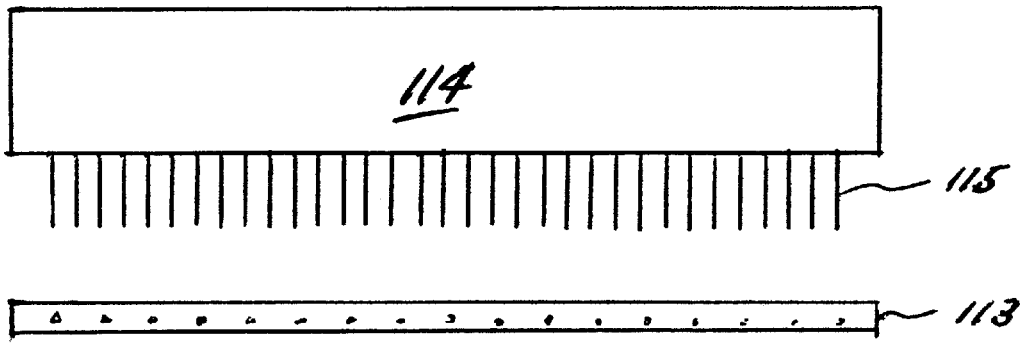
FIG. 4 is a partially schematic front view of a needle bar of a tufting machine with an adjacent advantageous directional air enhancement system of the present invention.

The relationships among the tufting machine needle bar 114 and the perforated tube 113 of the directional air supply system of the present invention are also schematically illustrated, with like reference numerals, in a top view in FIG. 3, from the direction of arrow III in FIG. 2, and in a front view in FIG. 4, from the direction of arrow IV in FIG. 2.

The region of a tufting machine which includes the needle box and adjacent advantageous directional air enhancement system of the present invention, including elements 112–116 of FIG. 2, is schematically illustrated in more detail in FIG. 1. FIG. 1 is primarily a copy of FIG. 1 of the aforementioned Dedmon U.S. Pat. No. 5,143,003, and the two-digit reference numerals therein are the reference numerals which appear in FIG. 1 of the Dedmon '003 patent. FIG. 1 includes an operative head portion of a tufting machine 10, shown in side elevation view in FIG. 1, including tufting head portion 12 incorporating reciprocating carrier 14 connected to stationary portion 16 of tufting machine 10. Carrier 14 is reciprocally driven in the direction of arrow 18 to perform sewing or stitching operations on base fabric 20 supported by means indicated at 22. Base fabric 20 moves in direction 117, right to left in the view illustrated in FIG. 1, in a plane substantially transverse to the direction of reciprocation of carrier 14.

Needle bar 28 reciprocates with carrier 14 which moves in the direction of arrow 18. Needle bar 28 carries needle means 30, shown as comprising pair of needles 32 and 34, respectively, although a plurality of substantially aligned needles extends across the width of the tufting machine. When needle bar 28 is reciprocated in the direction of arrow 18, needles 32, 34 are reciprocated substantially transversely to the plane of base fabric 20. For further details of such tufting machines, see the Dedmon '505 and Dedmon '003 patents.

As shown in FIG. 1, the advantageous directional air enhancement system of the present invention, and particularly perforated tube or manifold 113 thereof, is located a short distance behind the needle bars carrying needles 32, 34, respectively, that is, upstream of those needles with respect to the direction of movement of base fabric 20. Perforated tube or manifold 113 is shown supported by support 119 extending from a guard member for input pin roller $R_1$, although the manifold may be supported from any stable portion of the tufting machine or adjacent structure. The manifold 113 may be constructed in any practically functional manner. For example, a tube about ½ inch in internal diameter, having outlet orifices of about 1/16 inch in diameter spaced about ½ inch between orifice centers, may perform satisfactorily, when spaced about 2 to 2½ inches behind the nearest row of needles.

Compressed air is supplied to the advantageous directional air enhancement system of the present invention through air supply 112, for example, from any available source, and can be supplied through that system and exit the orifices in that system either continuously, or in any desired controlled or intermittent manner depending upon the desired tufted textile product to be made with a tufting machine equipped with the advantageous directional air improvement of the present invention. While air supply 112 is shown entering manifold 113 at its center, multiple air supply conduits 112 may be used, for example serving manifold 113 at its ends as well as near its center.

The desirable directional air of the present invention emerges from orifices in the left exterior of perforated tube or manifold 113. Tube or manifold 113 runs substantially parallel to the needles and needle bar, across the tufting machine. The directional air 116 emerging from the orifices in perforated tube 113 flows in substantially the same direction as the movement of the base fabric.

While the perforated tube and manifold 113 are here described as a tube having a plurality of orifices in the side wall substantially along a line parallel to the longitudinal axis of the tube, which tube extends across the tufting machine behind the needle bars, it will be appreciated that the manifold and the openings therein may have any suitable size or shape.

The objective is to deliver a stream or sheet of air adjacent the plane of the base fabric toward the needles, substantially parallel to the base fabric plane, with the stream or sheet of air being of sufficient volume and moving faster than, but in substantially the same direction of movement as, a base fabric being tufted by said machine. The desired effect of this stream or sheet of air adjacent the base fabric and moving parallel to the direction of movement of the base fabric is to align, substantially parallel to the direction of movement of the base fabric, fiber or yarn tails extending from needles anywhere across the width of the fabric being tufted. Thus aligning fiber or yarn tails protruding from one or more tufting needles prevents such yarn or fiber tails from becoming entangled with yarn from adjacent needles in the same row of the needle bar, and/or with yarn or fiber tails from needles in a trailing row of needles on the needle bar. Preventing entanglement of yarn or fiber tails from adjacent needles provides a more uniformly tufted textile product, and provides greatly improved color separation and distinctness where the yarns being inserted by adjacent needles are yarns of different colors.

While the advantageous directional air enhancement system for textile tufting machines of the present invention has been described in conjunction with certain presently preferred embodiments and alternative modifications and constructions thereof, those skilled in the art will appreciate that any modifications or changes of the disclosed form of the invention are still within the spirit and scope of the invention as defined in the following claims, or equivalents of that claimed subject matter, which are intended to be covered within the lawful scope of those claims.

What is claimed is:

1. A tufting machine for inserting yarns into stitching in a base fabric:

at least one needle bar means;

a reciprocating carrier for the needle bar means;

means for supporting said base fabric in a plane substantially transverse to the reciprocation direction of said carrier;

needle means carried by said needle bar means for penetrating said fabric whereby reciprocation of said carrier imparts a reciprocating movement to said needle means which are moved along at least one preselected axis substantially transverse to said base fabric plane; and means for delivering a stream or sheet of air adjacent the base fabric plane toward said needle means and substantially parallel to said plane, and moving faster than and in substantially the direction of movement of a base fabric being tufted by said machine, for aligning substantially parallel to said direction of movement at least one fiber or yarn tail extending from said needle means.

2. The tufting machine of claim 1, wherein said needle means comprises a plurality of needles, and said means for delivering comprises means for delivering a plurality of said small diameter streams of air toward a plurality of said needles.

3. The tufting machine of claim 2, wherein said plurality of streams merge into a sheet of air moving substantially parallel to the direction of movement of a base fabric.

4. The tufting machine of claim 1, wherein said delivering means comprises an air manifold extending across the machine behind and substantially parallel to the needle bar, said manifold having one or more orifices therein for permitting said air stream to be delivered.

5. The tufting machine of claim 2, wherein said manifold is an air conduit having a plurality of orifices therein, said orifices being located substantially along a line parallel to the longitudinal axis of the conduit, which axis extends across the machine.

6. The tufting machine of claim 1, wherein said needle means comprises a plurality of needles, said means for delivering comprises means for delivering said stream or sheet of air toward most of said plurality of needles.

* * * * *